US009149847B2

(12) United States Patent
Holden

(10) Patent No.: US 9,149,847 B2
(45) Date of Patent: Oct. 6, 2015

(54) INDENTED TUBE FOR A HEAT EXCHANGER

(75) Inventor: Jerry L. Holden, Smithville, TN (US)

(73) Assignee: Halla Visteon Climate Control Corporation, Daejeon-si (KR)

( * ) Notice: Subject to any disclaimer, the term of this patent is extended or adjusted under 35 U.S.C. 154(b) by 2756 days.

(21) Appl. No.: 10/584,033

(22) PCT Filed: Jan. 4, 2005

(86) PCT No.: PCT/US2005/000095

§ 371 (c)(1),
(2), (4) Date: May 1, 2007

(87) PCT Pub. No.: WO2005/068101

PCT Pub. Date: Jul. 28, 2005

(65) Prior Publication Data

US 2007/0235163 A1 Oct. 11, 2007

Related U.S. Application Data

(60) Provisional application No. 60/534,217, filed on Jan. 5, 2004.

(51) Int. Cl.
*B21C 37/15* (2006.01)
*B21C 37/20* (2006.01)
(Continued)

(52) U.S. Cl.
CPC ..... *B21C 37/158* (2013.01); *B21C 37/15* (2013.01); *B21C 37/202* (2013.01); *B21D 17/02* (2013.01); *B21D 53/06* (2013.01); *F28D 7/16* (2013.01); *F28F 1/006* (2013.01); *F28F 1/025* (2013.01); *F28F 1/06* (2013.01); *F28F 1/42* (2013.01); *F28F 1/426* (2013.01); *F28D 21/0003* (2013.01); *F28F 2210/06* (2013.01)

(58) Field of Classification Search
CPC ..... B21C 37/158
USPC ..... 72/370.16, 370.19, 370.21, 77, 78, 98, 72/370.12, 370.13, 367.1, 368, 80, 95, 72/100, 370.04, 370.14, 370.23, 370.24, 72/370.25
See application file for complete search history.

(56) References Cited

U.S. PATENT DOCUMENTS 2,864,588 A 12/1958 Booth et al.
3,494,170 A 2/1970 Valleins
(Continued)

FOREIGN PATENT DOCUMENTS

EP 1 113 237 7/2001
EP 1 221 579 7/2002
(Continued)

OTHER PUBLICATIONS

International Search Report dated Apr. 11, 2005.

*Primary Examiner* — Shelley Self
*Assistant Examiner* — Mohammad I Yusuf
(74) *Attorney, Agent, or Firm* — Carlson, Gaskey & Olds, P.C.

(57) ABSTRACT

A shell tube and heat exchanger (10) includes a plurality of tubes surrounded by a shell (16). Each tube (12) includes a plurality of indentations. A mold is placed in a desired positions and orientation in a die. A tube is placed in a first position within a die, and the mold crimps the tube to form the desired indentation in the tube. The mold is then released, and the tube is moved relative to the mold to a second position. The mold again crimps the tube to form an additional indentation. Alternately, the mold includes a roller that forms a groove on the tube. The tube is translated or both translated and rotated relative to the mold to form the groove.

7 Claims, 4 Drawing Sheets

(51) Int. Cl.

| | |
|---|---|
| ***B21D 17/02*** | (2006.01) |
| ***B21D 53/06*** | (2006.01) |
| ***F28D 7/16*** | (2006.01) |
| ***F28F 1/00*** | (2006.01) |
| ***F28F 1/02*** | (2006.01) |
| ***F28F 1/06*** | (2006.01) |
| ***F28F 1/42*** | (2006.01) |
| *F28D 21/00* | (2006.01) |

(56) References Cited

U.S. PATENT DOCUMENTS

| | | | | | |
|---|---|---|---|---|---|
| 3,887,004 | A | * | 6/1975 | Beck | 29/890.047 |
| 4,179,911 | A | * | 12/1979 | Saier et al. | 72/78 |
| 4,574,610 | A | * | 3/1986 | Hull et al. | 72/370.23 |
| 4,715,436 | A | | 12/1987 | Takahashi et al. | |
| 5,375,654 | A | | 12/1994 | Hougland et al. | |
| 5,806,359 | A | * | 9/1998 | Hequet | 72/229 |
| 5,964,127 | A | * | 10/1999 | Steingroever | 72/56 |
| 6,116,026 | A | | 9/2000 | Freese | |
| 6,488,078 | B2 | | 12/2002 | Beutler et al. | |
| 2002/0121361 | A1 | | 9/2002 | Zifferer | |

FOREIGN PATENT DOCUMENTS

| | | |
|---|---|---|
| JP | 58035023 | 3/1983 |
| JP | 59035834 | 2/1984 |
| JP | 07218037 | 8/1995 |
| JP | 10024337 | 1/1998 |
| WO | WO 86/01441 | 3/1986 |

* cited by examiner

INDENTED TUBE FOR A HEAT EXCHANGER

BACKGROUND OF THE INVENTION

The present invention relates to a method for forming a tube used in a heat exchanger including a plurality of indentations that increase heat transfer between a fluid flowing through the tube and a fluid flowing around the tube.

A shell and tube heat exchanger is used to cool fluids in various automotive applications, including exhaust gas recirculation coolers and power steering devices. In an engine gas recirculation system, an exhaust fluid flows inside the tube and exchanges heat with a coolant flowing around the tube. The exhaust fluid closer to the tube wall cools faster than the exhaust fluid flowing in the center of the tube.

In the prior art, the tubes in the heat exchanger can be bent or twisted to create turbulence in the exhaust fluid and to provide a non-linear flow path to increase heat transfer.

There are several drawbacks to the bent or twisted tubes of the prior art. For one, it is difficult to manufacture the tubes. Additionally, it is both costly and laborious to twist and bend the tubes to the desired shape.

Hence, there is a need in the art for a method for shaping a tube used in a heat exchanger that overcomes the drawbacks and shortcomings of the prior art.

SUMMARY OF THE INVENTION

A shell and tube heat exchanger includes a plurality of tubes surrounded by a shell. Each of the tubes includes a plurality of indentations. A cooling fluid flowing through the shell exchanges heat with a hot fluid flowing through the tubes. Preferably, the shell and tube heat exchanger is used in an exhaust gas recirculation system, and an exhaust fluid flows through the tubes and exchanges heat with a coolant flowing through the shell.

The tube includes indentations that increase the surface area of the tubes and the amount of fluid located proximate to the walls of the tubes. The indentations also create turbulence in the fluid flowing through the tubes.

In one example, a mold of a desired shape is placed in a desired position and orientation in a die. The tube is placed in a first position within the die, and the mold crimps the tube to form the desired indentation in the tube. The mold is then released, and the tube is moved relative to the mold. The mold then again crimps the tube to form an additional indentation. The tube can be translated relative to the mold or can be both translated and rotated relative to the mold.

Alternately, the mold includes a roller that forms parallel grooves on the tube. The tube is translated relative to the mold to form the grooves on the surface of the tube. The number of rollers determines the number of grooves. Alternately, the tube is both translated and rotated relative to the mold to form a spiral groove on the surface of the tube.

These and other features of the present invention will be best understood from the following specification and drawings.

DETAILED DESCRIPTION OF THE PREFERRED EMBODIMENT

Figure 1:
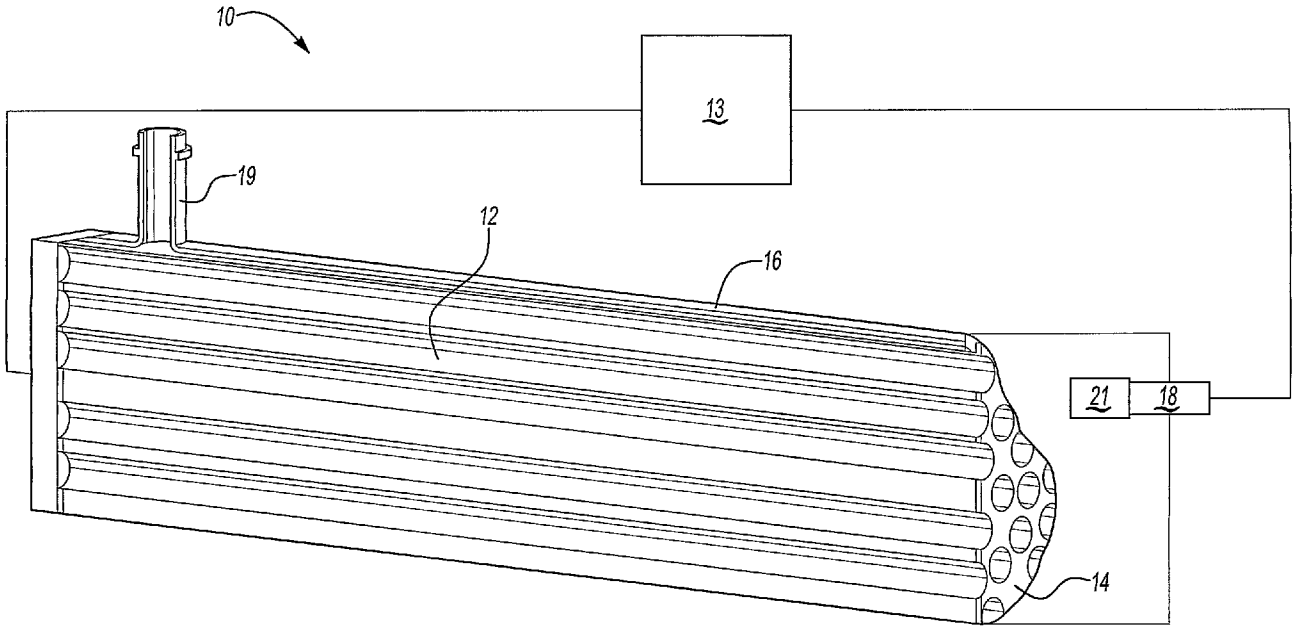
FIG. 1 illustrates a cross-section of a shell and tube heat exchanger.

FIG. 1 illustrates a shell and tube heat exchanger 10 including a plurality of tubes 12 surrounded by a shell 16. Opposing end portions 26 of the tubes 12 are attached to a plate 14. The end portions 26 of the tubes 12 can be attached to the plate 14 by welding, press-fitting, or by any other means of attachment. A cooling fluid enters the heat exchanger 10 through an inlet 18 located at one end of the heat exchanger 10. The cooling fluid flows through the shell 16 and exchanges heat with a hot fluid that flows through the tubes 12. The fluid in the shell 16 exits the heat exchanger 10 through an outlet 19.

If the heat exchanger 10 is used with an exhaust gas recirculation system, an exhaust gas recirculation valve 21 controls the flow of hot fluid from an engine 13 or other component into the heat exchanger 10. If the heat exchanger 10 is used in an exhaust gas recirculation system, the hot fluid is an exhaust fluid. The hot exhaust fluid enters the tubes 12, and heat is transferred from the hot exhaust fluid to a coolant flowing in the shell 16 surrounding the tubes 12. The cooled exhaust fluid in the tubes 12 is then recirculated to the engine 13 or other component. Although an exhaust gas recirculation system has been illustrated and described, it is to be understood that other applications utilizing a tube and shell heat exchanger 10 may also use the tubes 12 of the present invention.

The tubes 12 include a plurality of indentations 30 that increase the surface area of the tubes 12, the amount of hot fluid that is proximate to the walls of the tubes 12 to increase the heat transfer, and the amount of turbulence in the fluid in the tubes 12. Creating turbulence in the hot fluid within the tubes 12 mixes the fluid in the center of the tube 12 and the fluid proximate to the walls of the tube 12. Thus, the fluid proximate to the walls of the tube 12 will continually change as the fluid circulates and flows through the tubes 12.

Figure 2:
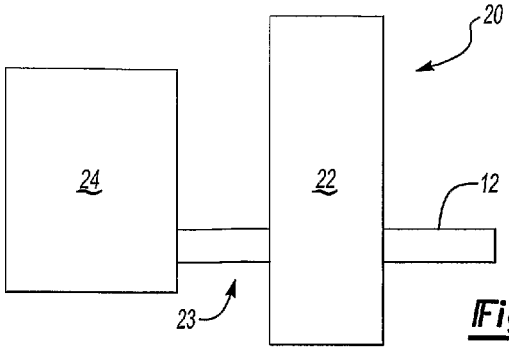
FIG. 2 illustrates a die for molding a tube of the present invention in a first position.
Figure 3:
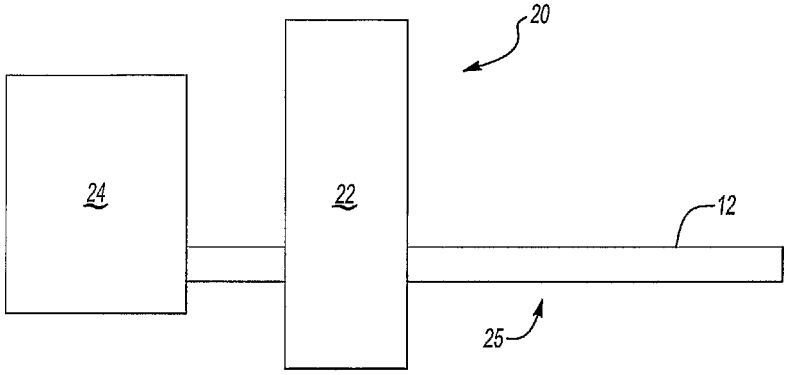
FIG. 3 illustrates the die for molding the tube in a second position.

FIGS. 2 and 3 illustrate the method of forming the tube 12 of the present invention. A mold 22 of a desired shape is placed in a desired position and orientation in a die 20. The tube 12 is positioned in a first position 23 within the die 20. The mold 22 then crimps the tube 12 to form an impression or indentation 30 in the tube 12. The mold 22 is then released. A moving device 24 both rotates and translates the tube 12 relative to the mold 22. Once the tube 12 is in a second position 25, as shown in FIG. 3, the mold 22 again crimps the tube 12 to form an additional indentation 30 in the tube 12. The process of translating and rotating the tube 12 and using the mold 22 to crimp the tube 12 may be repeated as many times as needed to form the desired number and orientation of indentations 30 in the tube 12.

Figure 4:
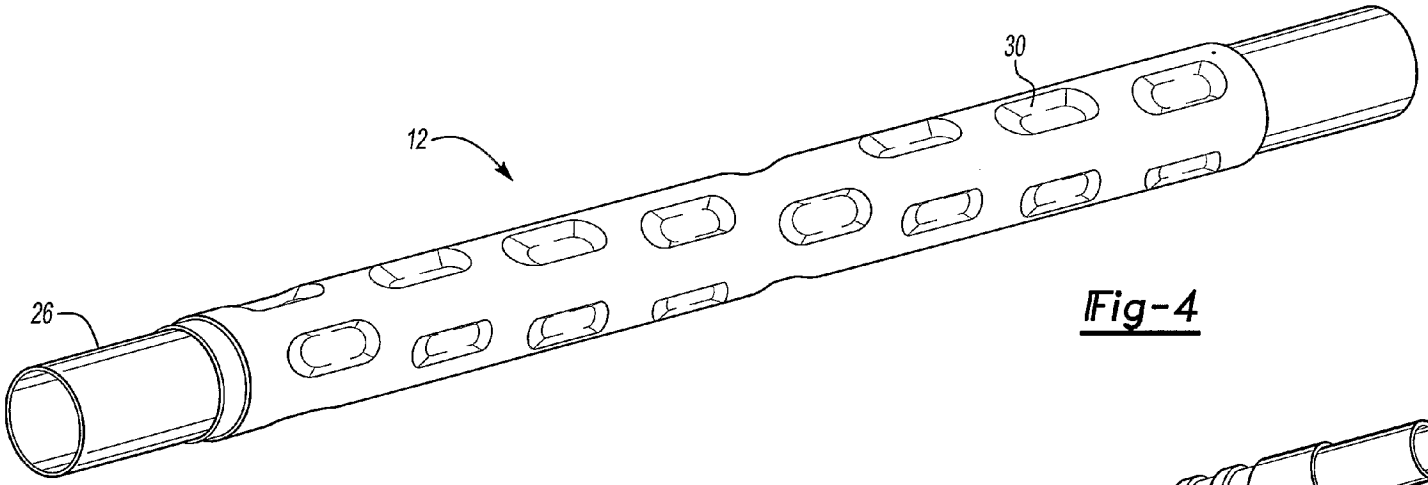
FIG. 4 illustrates a perspective view of a first embodiment of the tube including angled indentations.

FIG. 4 shows a first embodiment of the tube 12 of the present invention. The mold 22 crimps the tube 12 to form indentations 30 in the tube 12. The mold 22 is released from the mold 22, and the tube 12 is rotated and translated relative to the mold 22. The mold 22 then again crimps the tube 12 to form an indentation 30. In one example, the tube 12 is rotated approximately 5 and 10 degrees between successive crimps.

Figure 5:
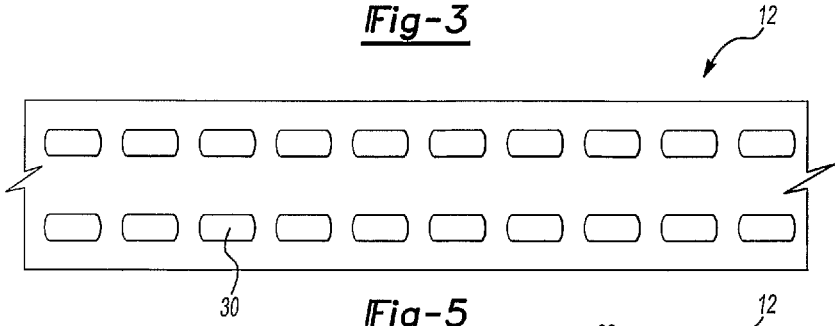
FIG. 5 illustrates a perspective view of the first embodiment of the tube including parallel indentations.
Figure 6:
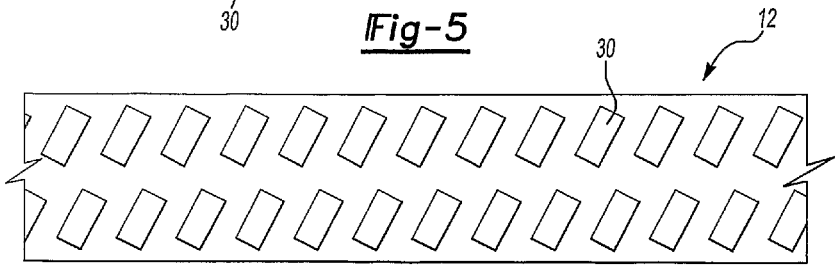
FIG. 6 illustrates a perspective view of the embodiment of the tube including different angled indentations.

Alternately, shown in FIG. 5, the tube 12 is only translated relative to the mold 22 and is not rotated when forming the indentations 30. The indentations 30 are substantially parallel to the flow path of the fluid flowing through the tube 12. Alternately, as shown in FIG. 6, the mold 22 can form indentations 30 that are angled relative to the flowpath of fluid flowing through the tube 12. In both these examples, the mold 22 is released from the tube 12 between successive crimps.

The amount of rotation and translation of the tube 12 relative to the mold 22 may be varied to produce a pattern of indentations 30 that creates a desired amount of turbulence in the fluid flowing through the tube 12. For example, forming the indentations 30 at an angle relative to the flow path of the fluid through the tubes 12 can increase the amount of turbulence. One skilled in the art would know the desired orientation of the indentations 30 in the tube 12 to produce the desired turbulence.

The tubes 12 include the opposing end portions 26 that preferably have a substantially uniform circular cross-sectional shape. The cross-sectional shape of the end portions 26 may differ from the cross section of the tube 12. That is, the cross-section of the end portions 26 corresponds to the cross-section of the desired connector. This allows the tube 12 to be easily attached to various other tubes, hoses, or other desired connectors. The end portion 26 may also be formed as different pieces and later attached to each of the tubes 12.

Figure 7:
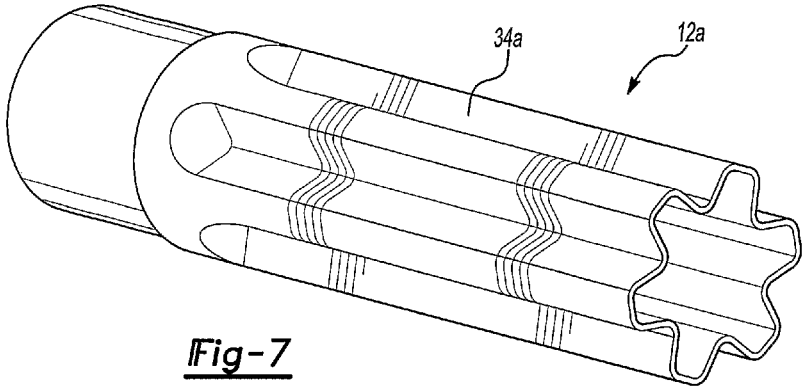
FIG. 7 illustrates a cross-sectional view of a second embodiment of the tube including six grooves.
Figure 8:
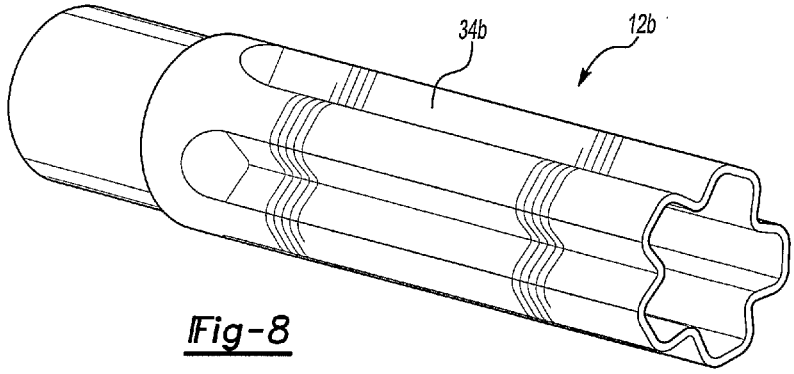
FIG. 8 illustrates a cross-sectional view of the second embodiment of the tube including five grooves.
Figure 9:
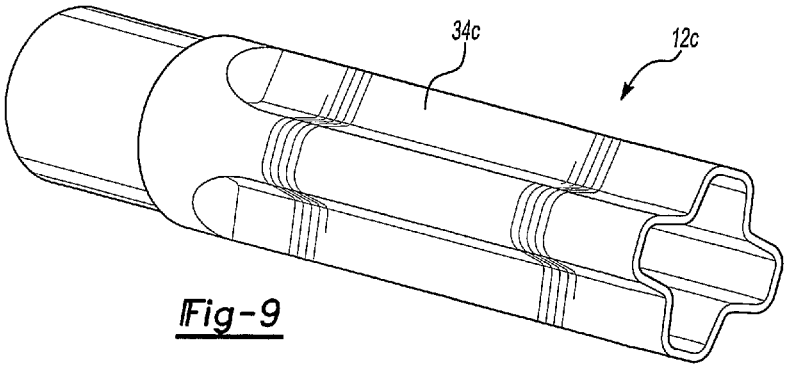
FIG. 9 illustrates a cross-sectional view of the second embodiment of the tube including four grooves.

FIGS. 7, 8 and 9 show an alternate embodiment of the tube 12 of the present invention. In these embodiments, the mold 22 includes a roller (not shown) installed within the die 20. The mold 22 is crimped on the tube 12, and the tube 12 is translated relative to the mold 22 without releasing the mold 22 from the tube 12. In this example, a continuous groove 34 is formed on the surface of the tube 12. The groove 34 increases the surface area of the tube 12, allowing more fluid to contact the walls of the tube 12 at a given time.

The mold 22 can include a plurality of rollers to form a plurality of substantially parallel grooves 34 on the tube 12. The rollers contact the tube 12 and are continuously crimped on the surface of the tube 12 to form parallel grooves 34 as the tube 12 translates relative to the rollers.

As shown in FIG. 7, one example tube 12*a* includes six grooves 34*a*. FIG. 8 shows another example tube 12*b* having five grooves 34*b*. FIG. 9 shows another tube 12*c* having four parallel grooves 34*c*.

Figure 10:
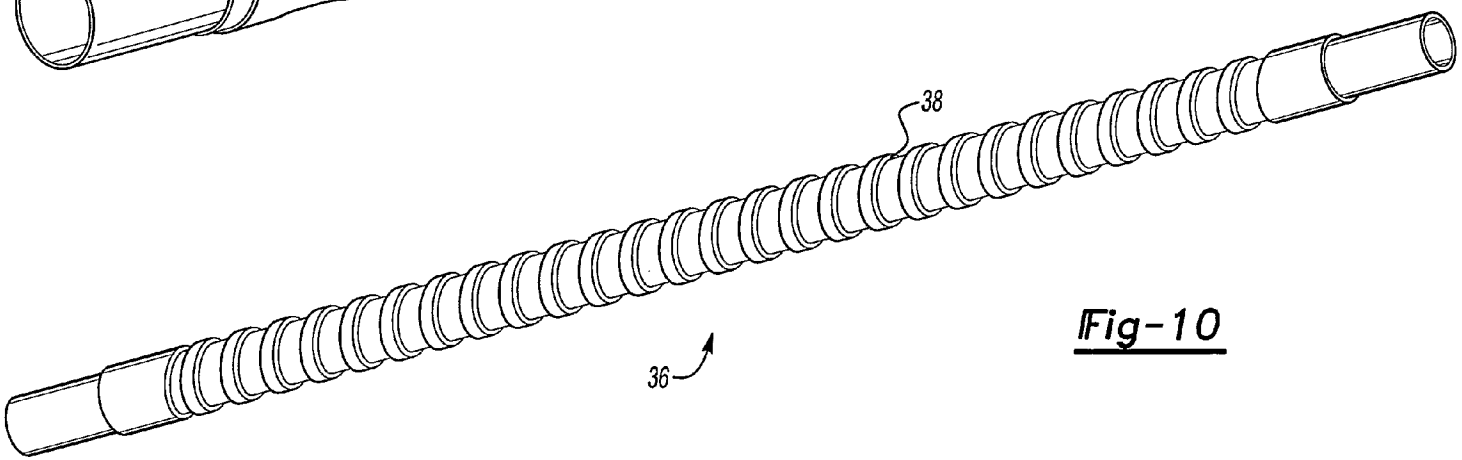
FIG. 10 illustrates a perspective view of a third embodiment of the indented tube including a spiral shaped groove.

FIG. 10 illustrates an alternate tube 12 including a substantially spiral shaped groove 38 formed on the wall of the tube 12. A roller contacts the wall of the tube 12 as the tube 12 is both rotated and translated relative to the mold 22 to form a substantially spiral shaped groove 38 on the tube 12. The roller is continuously crimped against the tube 12 while the tube 12 is both rotated and translated. The angle at which the roller is placed against tube 12 and the amount of translation and rotation of the tube 12 can be varied to produce the desired spiral shaped groove 38. Alternately, several rollers can be employed.

Although a preferred embodiment of this invention has been disclosed, a worker of ordinary skill in this art would recognize that certain modifications would come within the scope of this invention. For that reason, the following claims should be studied to determine the true scope and content of this invention.

The invention claimed is:

1. A method of forming a tube comprising the steps of:

positioning the tube in a first position relative to a mold, wherein an entirety of the mold is located outside of the tube;

forming an indentation on the tube with a mold;

releasing the mold from the tube; and moving the tube to a second stationary position relative to the mold, wherein the stop of forming and releasing occur after the step of positioning the tube in the first stationary position, and the step of moving occurs after the step of releasing, wherein the step of moving includes rotating and axially translating the tube relative to the mold.

2. The method as recited in claim 1 further including the step of repeating the step of forming an indentation when the tube is in the second stationary position.

3. The method as recited in claim 1 further including the step of repeating the step of forming an indentation when the tube is in the second stationary position, wherein the step of rotating includes rotating the tube relative to the mold between approximately 5 to 10° between each of the step of repeating.

4. A method of forming a tube, the method comprising the steps of:

positioning the tube in a mold at a first position, wherein an entirety of the mold is located outside of the tube;

forming an indentation on the tube with the mold;

releasing the mold from the tube;

axially translating the tube to a second position relative to the mold subsequent to the step of releasing the mold from the tube, wherein the tube rotates during the step of axially translating; and forming a second indentation on the tube with the mold.

5. A method of forming a tube, the method comprising the steps of:

positioning the tube in a mold at a first position;

rolling the tube with a roller in the mold to form an indentation in the tube such that the roller engages the tube;

axially translating the tube from the first position to a second position relative to the mold, wherein the step of rolling the tube occurs during the step of axially translating the tube such that the roller continually engages the tube during the step of axially translating the tube; and releasing the mold from the tube after the step of axially translating the tube.

6. The method as recited in claim 5 further including the step of rotating the tube, wherein the step of rotating the tube and the step of axially translating the tube occur simultaneously.

7. The method as recited in claim 6 wherein the step of rotating the tube includes rotating the tube between 5 and 10 degrees.

* * * * *

UNITED STATES PATENT AND TRADEMARK OFFICE

CERTIFICATE OF CORRECTION

PATENT NO. : 9,149,847 B2
APPLICATION NO. : 10/584033
DATED : October 6, 2015
INVENTOR(S) : Jerry L. Holden It is certified that error appears in the above-identified patent and that said Letters Patent is hereby corrected as shown below:

IN THE CLAIMS:

In claim 1, column 4, line 8; delete "tube" and insert --tube, the method--

In claim 1, column 4, line 9; after "first" insert --stationary--

In claim 1, column 4, line 12; delete "a" and insert --the--

In claim 1, column 4, line 15; delete "stop" and insert --step--

Signed and Sealed this
Fifteenth Day of March, 2016

Michelle K. Lee

Michelle K. Lee
*Director of the United States Patent and Trademark Office*